US009265303B2

(12) United States Patent
Hoogerbrugge et al.

(10) Patent No.: US 9,265,303 B2
(45) Date of Patent: Feb. 23, 2016

(54) INSOLE PAD FOR FOOTWEAR

(75) Inventors: Edwin Paul Hoogerbrugge, Woerden (NL); Bas Brongers, Den Haag (NL); Joost Robert van Haasteren, Rotterdam (NL)

(73) Assignee: S.C. Johnson & Son, Inc., Racine, WI (US)

( * ) Notice: Subject to any disclaimer, the term of this patent is extended or adjusted under 35 U.S.C. 154(b) by 422 days.

(21) Appl. No.: 13/813,033

(22) PCT Filed: Oct. 25, 2010

(86) PCT No.: PCT/NL2010/050710

§ 371 (c)(1), (2), (4) Date: Apr. 23, 2013

(87) PCT Pub. No.: WO2012/021058

PCT Pub. Date: Feb. 16, 2012

(65) Prior Publication Data

US 2014/0109438 A1 Apr. 24, 2014

(30) Foreign Application Priority Data

Aug. 13, 2010 (NL) ..... 2005226

(51) Int. Cl.

*A43B 13/40* (2006.01)
*A43B 3/00* (2006.01)
*A43B 13/18* (2006.01)
(Continued)

(52) U.S. Cl.

CPC ..... *A43B 13/40* (2013.01); *A43B 3/0078* (2013.01); *A43B 13/186* (2013.01); *A43B 17/02* (2013.01); *A43B 17/18* (2013.01); *A43B 23/24* (2013.01)

(58) Field of Classification Search

CPC .... A43B 7/1425; A43B 13/16; A43B 13/186; A43B 13/187; A43B 13/188; A43B 13/14; A43B 7/14–77/145

USPC ..... 36/43, 44, 71, 140

See application file for complete search history.

(56) References Cited

U.S. PATENT DOCUMENTS 2,347,207 A * 4/1944 Margolin ..... 36/3 B
6,138,383 A 10/2000 Steinke et al.
(Continued)

FOREIGN PATENT DOCUMENTS

EP 1 459 638 9/2004

OTHER PUBLICATIONS

International Search Report for International Application No. PCT/NL2010/050710, dated Apr. 18, 2011, 3 pages.
(Continued)

*Primary Examiner* — Jila M Mohandesi

(57) ABSTRACT

A insole pad (1; 51) for placement on top of an inner sole of footwear and adapted in use to cover only an area of that inner sole that is substantially smaller than the human footprint. The insole pad (1; 51) includes a relatively thin, sheet-like body that has an upper surface (33) and a lower surface (41) and an outer periphery (25). The lower surface (41) has sticky or adhesive properties, and is interrupted by recessed areas arranged in a pattern (5; 55). The pattern (5; 55) is configured to include a plurality of channels combined to be at least intersecting or joining, so as to define a plurality of differently sized non-recessed lower surface areas. At least a portion of the channels vary in width, while the pattern has a varying density to provide high and low cushioning values in pre-defined areas A, B, C; G).

31 Claims, 6 Drawing Sheets

(51) Int. Cl.

| | |
|---|---|
| ***A43B 17/02*** | (2006.01) |
| ***A43B 17/18*** | (2006.01) |
| ***A43B 23/24*** | (2006.01) |

(56) References Cited

U.S. PATENT DOCUMENTS

| | | | | |
|---|---|---|---|---|
| 6,598,321 | B2 * | 7/2003 | Crane et al. | 36/43 |
| 6,763,613 | B2 * | 7/2004 | Brown | 36/44 |
| 6,789,333 | B2 * | 9/2004 | Nishiwaki et al. | 36/28 |
| 7,140,126 | B2 * | 11/2006 | Crane et al. | 36/43 |
| 7,159,342 | B2 * | 1/2007 | Grisoni et al. | 36/180 |
| 2007/0022630 | A1 | 2/2007 | Lundy et al. | |

OTHER PUBLICATIONS

Written Opinion of the ISA for International Application No. PCT/NL2010/050710, dated Apr. 18, 2011, 4 pages,

* cited by examiner

INSOLE PAD FOR FOOTWEAR

CROSS-REFERENCE TO RELATED APPLICATIONS

The present application claims priority as a national stage application of International Patent Application No. PCT/NL2010/050710 filed on Oct. 25, 2010, which claims priority to Netherlands Patent App. No. NL2005226 filed on Aug. 13, 2010, both of which are hereby incorporated herein by reference in their entireties.

BACKGROUND

The invention relates to an insole pad, such as a partial insole, for placement on top of an inner sole of footwear. The invention may however also be applied to full-length insoles. Partial insoles could include a ball of foot, or forefoot pads and a heel pads, but is not limited thereto. The partial insoles to which the invention relates are preferably smaller than the human footprint and are then used exclusively to cover only a portion of the inner soles of footwear.

Partial insoles, such as for supporting the ball of foot area of the human foot, are known. A way to provide cushioning properties to such pads is by providing them with protruding structures, such as ribs or columns to the bottom surface thereof. Usually these are arranged as geometric shapes that are distributed more or less uniformly over the area providing the cushioning properties. For cushioning energy during walking or running these uniformly arranged geometric structures are often allowed to buckle or collapse, as this was believed to improve the cushioning properties. However it is also important for partial insoles to have good adherence of the lower or bottom surface to the location of the inner sole of footwear, for which they are intended. Good adherence does benefit from possibly large adherence surfaces and adherence surfaces that show as little as possible deformation during use. In this regard the known structures have shown certain shortcomings, because the surface area available for adherence has been generally smaller that the surface area interrupted by the voids between the geometric structures. Overcoming these drawbacks by using stronger adhesives has introduced the problem of footwear damage when it was attempted to remove or replace the partial insoles at the end of their useful life.

SUMMARY

Accordingly it is an object of the present invention to propose an improved insole pad that provides cushioning properties in combination with a sufficiently large surface for adhering to footwear. In a more general sense it is thus an object of the invention to overcome or ameliorate at least one of the disadvantages of the prior art. It is also an object of the present invention to provide alternative structures which are less cumbersome in manufacture and use and which moreover can be made relatively inexpensively. Alternatively it is an object of the invention to at least provide the public with a useful alternative.

To this end the invention provides an insole pad for placement on top of an inner sole of footwear and adapted in use to cover only an area of that inner sole that is substantially smaller than the human footprint, the insole pad including a relatively thin, sheet-like body having an upper surface and a lower surface, wherein the lower surface has sticky or adhesive properties, wherein the lower surface is interrupted by recessed areas arranged in a pattern, and wherein the pattern is configured to include a plurality of channels combined to be at least one of intersecting and joining, to define a plurality of differently sized non-recessed lower surface areas, and at least a portion of the channels varying in width, which pattern has a varying density to provide high and low cushioning values in predefined areas. The invention is based on the discovery that a pattern of intersecting negative ribs, in the form of channels, can be used to achieve similar, if not better, cushioning properties than was the case with uniformly arranged protruding geometric structures.

The invention also solves the problem of providing areas for high and medium cushioning energy requirements in one and the same insole pad, by arranging for a non-uniform pattern. It has surprisingly been found that inverting the generally accepted pattern of protrusions to a pattern of recesses, provides all the benefits of cushioning while leaving a much larger area for adhesion that moreover is less prone to deformations during use.

The enlarged area for adherence also enables the use of the inherent sticky properties of PU-gel (polyurethane gel), that also allows easy removal without risk of damaging footwear, even after prolonged periods of use.

Advantageously the insole pad is adapted for attachment to one of a ball of foot and a heel area of the footwear. This allows for cushioning of the human foot in areas where this is most beneficial.

A first portion of the lower surface available for adherence to an item of footwear preferably exceeds substantially a second portion of the lower surface that is interrupted by channels of the pattern. This not only provides for sufficient adherence of only moderately adhesive surfaces, but reduces deformations and/or movement between the adhered surfaces. Moderately adhesive surfaces are a benefit when insole pads need to be removable without inflicting damage on the footwear.

Insole pads according to the invention can also consist substantially of an elastomeric material. In such an insole pad the elastomeric material can advantageously be a gelatinous elastomeric material. Selections of such elastomeric material may be a visco-elastic gel, or a polyurethane gel (PU-gel). With such materials preferably inherent sticky or adhesive properties of the elastomeric material are adapted to be used for adherence to an item of footwear. Polyurethane gels are manufactured by mixing polyols and isocyanates at a specified ratio. Sticky properties are obtained by using excess of polyol. The adhesiveness can be tuned to requirement by changing the ratio between the two components. Too low an adhesiveness of the gel will allow the gel pad to move around in the shoe during use, whereas too high an adhesiveness may result in the gel pad damaging the shoe inner when it is removed from the shoe.

Conceivably a thin full-length insole can also advantageously be made of sticky PU gel with a channel pattern, to prevent it from buckling, or otherwise moving or dislocating during use.

The elastomeric material can further also be a thermoplastic elastomer gel (TPE-gel), such as those based on styrene ethylene-butylene-styrene (SEBS) or based on silicone rubber. SEBS-based gels are somewhat cheaper than PU-gels, but they lack the inherent adhesive properties. An adhesive layer can be separately provided to make this option viable, or alternatively adhesive polymers can be added to the SEBS compound.

Further it is advantageous, when the channels are at least partly arranged in an intersecting swirl pattern. This provides the opportunity to vary the density of the pattern gradually and without interruptions.

It is further advantageous, when the relatively thin, sheet-like body has a transverse cross section that tapers outwardly towards its outer periphery. This makes for a smooth transition of the insole pad or partial insole to the inner sole of an item of footwear. This benefits comfort of the user and also reduces risks of disturbing the adherence of the pad when a human foot is inserted into the item of footwear. Such a disturbance is also counteracted, when there is relative movement of the human foot in respect of the item of footwear during use, such as during walking or running. In this regard it may be of additional benefit, when the transverse cross section has a thickness varying between 2.2 and 5.0 mm.

Preferably the channels of the insole pad according to the invention have a depth of 60% to 75%, more preferably 67%, of the total thickness of the sheet-like body. The width of the channels of the insole pad according to this invention preferably ranges from 0.5 to 2.5 mm.

The provision of the channels according to the invention may thereby account for the recessed areas to amount to a total weight reduction of 15 to 25% compared to an insole pad that would not be interrupted by a pattern. This significant saving on raw materials results into a reduction of the cost to produce this insole pad, while improving at the same time its cushioning properties. In particular elastomeric gel materials tend to have a noticeable mass, that adds to the weight of shoe wear and may detract from the comfort of then wearer. A substantial weight reduction therefore is a not unwelcome benefit.

Insole pad according to the invention at the contoured outer periphery may have an area extending 5 mm inwardly thereof, which area is substantially devoid of the pattern. This can increase the adherence in the border region of the insole pad or partial insole.

Further the insole pad according to the invention may preferably have its sticky lower surface covered by a removable protective layer, which is adapted to be peeled off prior to placement on top of an inner sole of the footwear. Such will protect the adhesive properties from deterioration and also facilitate packaging and shipping of the product to the user.

The upper or top surface of the insole pad according to this invention is optionally equipped with a plastic film. This film avoids that that the feet (with or without socks or stockings) is not in direct contact with the polyurethane gel. The polyurethane gel is sticky and as such will stick to the foot skin or the socks or sticking, which would be perceived as uncomfortable to the wearer of the insole pad. The film on top of the insole pad is typically made of thermoplastic polyurethane, and does not stick to the foot or socks. It also prevents the PU-gel from attracting dirt. Alternatively the film may also be replaced by a suitable fabric, suede, or non-woven materials.

Advantageously the channels of the pattern in the areas with a high cushioning value are spaced from one another at a distance smaller than in the areas of low cushioning value.

A further advantage of the channels in the pattern is that the thickness of the partial insole or insole pad according to this invention is significantly reduced when a load is applied. The thickness is reduced by about 30% when a pressure of 360 KPa is applied, which is typical during walking. This is particularly advantageous when the insole pad is worn in tight fitting footwear, such as fashion shoes.

Preferred applications of the insole pad according to the invention comprise in particular a ball of foot support pad or a heel area support pad as embodiments of a partial insole. However these specifically advantageous applications should be understood not to exclude other forms of partial insoles or indeed possible full length insoles.

The material used for the insole pad according to the invention also preferably has a uniform hardness throughout. This enables the pad like structures to be manufactured economically by using simple casting or injection moulding processes or the like. Such uniform hardness is advantageously within a range of between 55 and 75 Shore OO, and more preferably about 60 Shore OO.

BRIEF DESCRIPTION OF THE DRAWINGS

Still further advantages may be revealed by the following description in which the invention is further elucidated with reference to the accompanying drawings, in which.

DETAILED DESCRIPTION OF EXEMPLARY EMBODIMENTS

Figure 1:
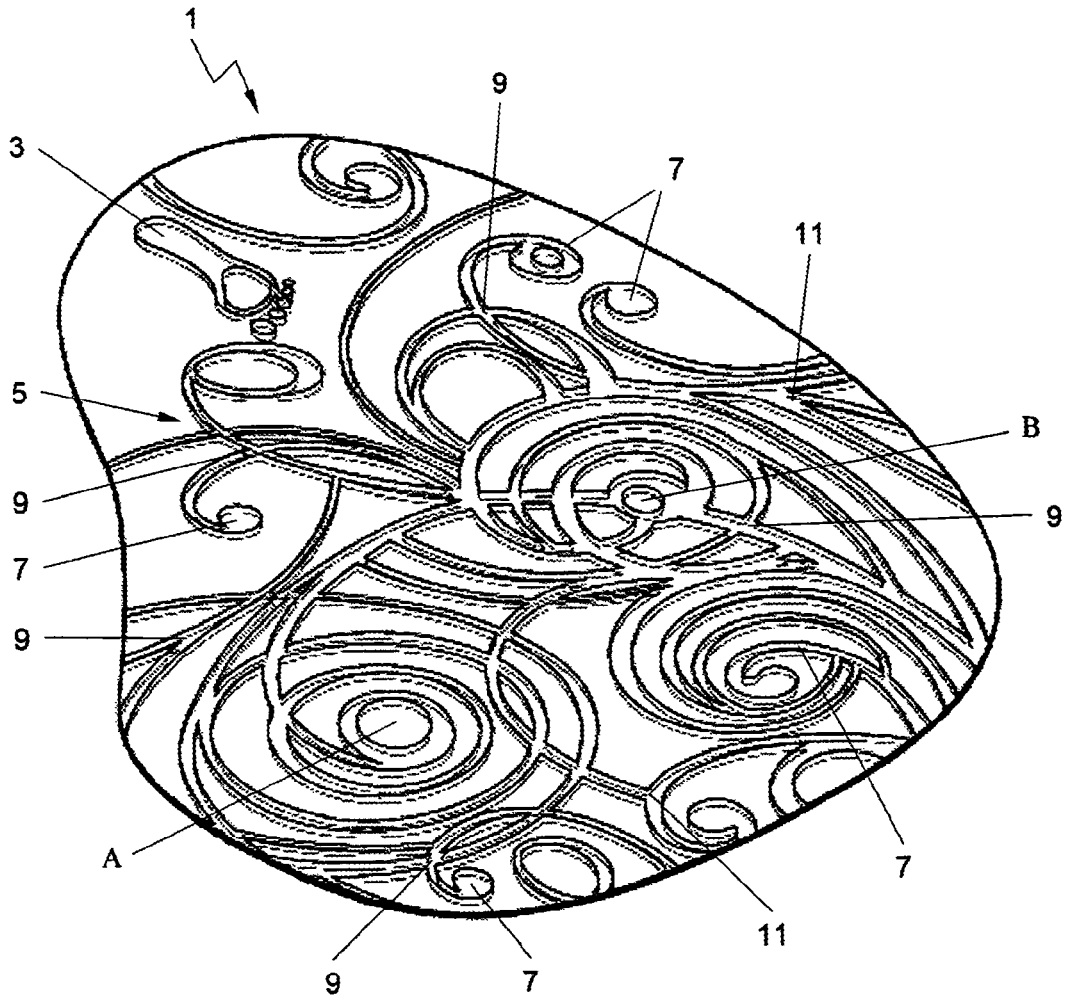
FIG. 1, in perspective, shows a first embodiment of a partial insole pad according to the invention.
Figure 2:
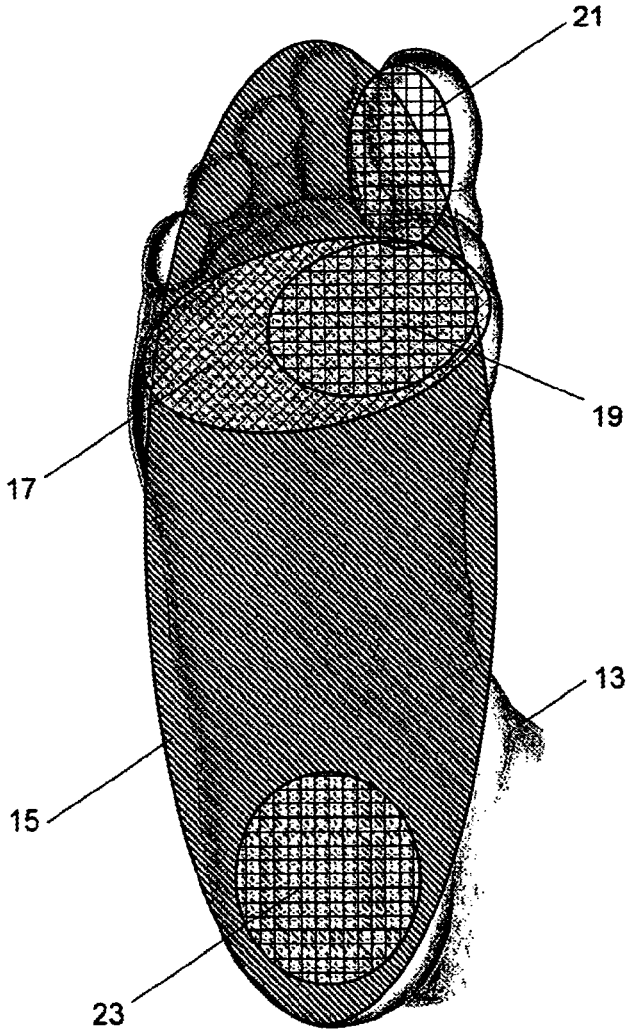
FIG. 2 is a human footprint showing the different areas of cushioning energy requirements.

In FIG. 1 a ball of foot partial insole pad 1 is shown. The insole pad 1 is adapted for placement on top of an inner sole of footwear to support and cushion a ball of foot. For proper insertion into the footwear an indicia 3 is incorporated within a pattern of recessed formations, generally indicated as 5. The pattern 5 includes recessed channels in a combination of swirls 7, intersections 9, junctions 11 and with varying widths. Only a few of the swirls 7, intersections 9 and junctions 11 are indicated in FIG. 1. The pattern 5 also is arranged in a varying density to provide higher and lower cushioning values in predefined areas, such as the areas A and B. The insole pad 1 of FIG. 1 is transparent, such that the channels forming the pattern 5, and which open into the bottom surface, may be seen in the perspective view of FIG. 1 showing the insole pad 1 from above. Rather than swirls the channels can also be formed in a coil-shaped pattern, with a centre of the coil-shaped pattern coinciding with a centre of an area of the human foot, which it is adapted to support in use, and which exerts the highest pressure across the foot during walking. FIG. 2 shows the bottom of a human foot 13, generally referred to as human footprint, indicated by a first shaded area 15. A second shaded area 17 indicates an area of the human foot print that has a medium cushioning energy requirement. The second shaded area 17 corresponds to the ball of foot adjacent to all five toes. A third shaded area 19 indicates the ball of foot portion directly adjacent the first three toes, which has a high cushioning energy requirement during walking and running. A fourth shaded area 21 indicates the area of the first toe, which may also have a high cushioning energy requirement, but for which the provision of cushioning should be regarded as optional because not all footwear allows the padding of this area without difficulty. A fifth shaded area 23 also has a high cushioning requirement as it support the heel of the human foot 13. Since the remainder of the footprint 15 is not critical and requires no cushioning during walking or running, the present invention envisions only the provision of partial insoles, such as in the form of ball-of-foot pads or heel pads. Footwear in the form of fashion shoes usually offers very little space for insoles and often does not allow the use of insoles in an unobtrusive manner. This problem can be solved by the partial insoles of the invention.

Figure 3:
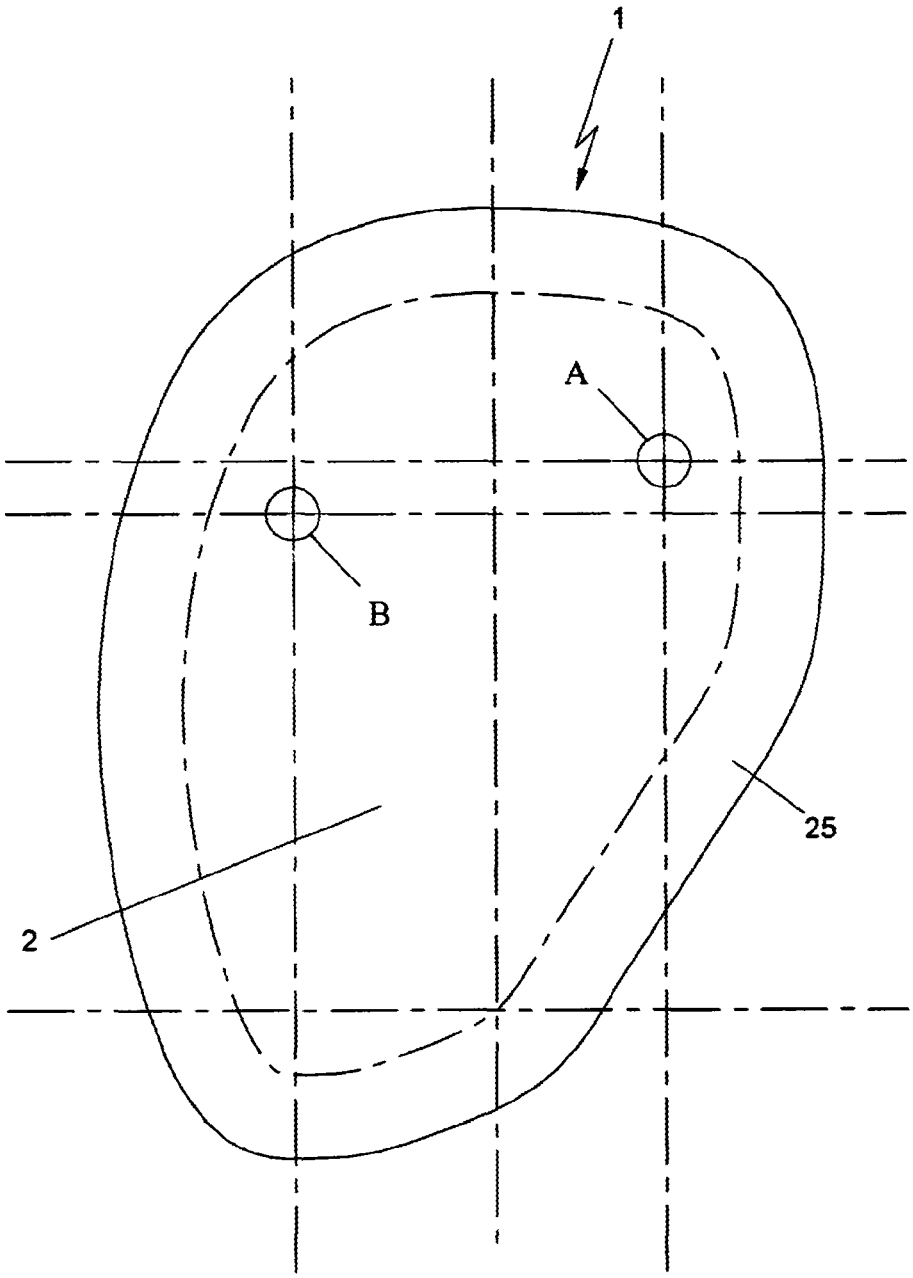
FIG. 3 is a schematic representation of the partial insole according to the first embodiment showing the differently functioning areas.

FIG. 3 schematically shows the different functional areas of the ball-of-foot pad of FIG. 1. The area A corresponds to a centre of maximum cushioning, which is adapted to support the ball of foot in proximity of the first three toes. It has been found that the area of maximum cushioning would advantageously extend over about 400 $mm^2$, based on the average size of the human foot. The area B corresponds to an area of medium cushioning and is proximate to the last toes of the foot under the ball of foot. The area B preferably extends over about 300 $mm^2$.

The outer perimeter of the fore foot pad as schematically shown in FIG. 3 also is contoured and gradually tapers from the area B to the outer peripheral edges of the forefoot pad. The patterned area, indicated by reference 27 in FIG. 3, has an extent of about 5400 $mm^2$.

Cushioning properties are provided by the recessed pattern of grooves 5 as shown in FIG. 1, by appropriately varying the shape, distribution and proportions of the recessed grooves or channels. This enables arranging for areas with different ratios between the voids formed by the groove pattern and the material of the pad, which is an elastomeric gel material. With elastomeric gel materials, such as PU-gel of TPE-gel, high cushioning energy can be provided by a pattern of grooves in which the void/gel-ratio is preferably about 35%. Medium cushioning energy, using such gel materials, may be obtained by arranging the groove pattern to provide a void/gel-ratio of preferably about 25%, and minimum cushioning energy may be provided with a void/gel-ratio of preferably about 10%. Cushioning properties are usually determined by using the SATRA PM159 test, a method well known to the footwear industry. Gel pads of 3.5 mm thickness without any channels or recessed areas show a cushioning energy of about 44 mJ in this test. Gel pads of the same thickness but equipped with a plurality of channels, in a density having a void/gel ratio of 35%, show a cushioning energy of about 56 mJ in the SATRA test. The higher the cushioning energy value is, the higher the cushioning properties will be.

More in particular the void/gel ratio can be subdivided to be within the following ranges: 30 to 45% for an area that requires high cushioning properties; 15 to 30% for an area that requires medium cushioning properties; and 0 to 15% an area that requires low cushioning properties.

Figure 4:
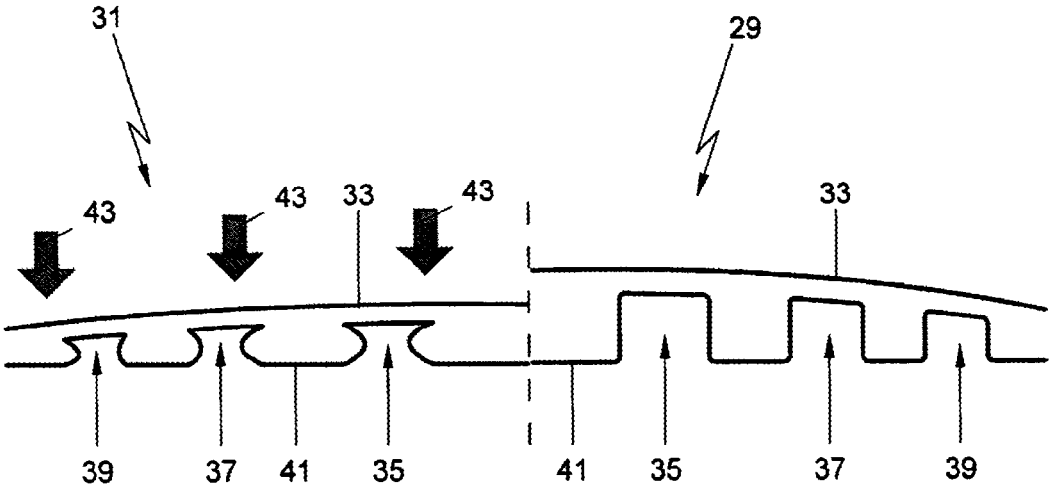
FIG. 4 is a schematic cross sectional detail in depressed and relaxed conditions.

FIG. 4 is a schematic representation of a partial cross section over a partial insole according to the invention. A right hand portion of FIG. 4 indicated as 29 shows the partial insole in a relaxed condition. In this relaxed condition there is little or no load on the top surface 33. The grooves or channels 35, 37, 39 interrupting the lower or bottom surface 41, still retain their original form. The left hand portion of FIG. 4, indicated as 31 shows a mirror image of the right hand portion 29, but placed under load as schematically represented by the arrows 43. With the bottom surface 41 resting on the inner sole of a shoe (deleted from FIG. 4 for clarity), it can be seen how the gel material of the non-grooved portions can deform using space provided by the voids created by the grooves 35, 37 and 39.

It can also been seen from FIG. 4 that by having the bottom surface 41 only interrupted by occasional grooves, a relatively large surface remains available for adhering to the inner sole of the shoe. This aspect is very important for a partial insole, for keeping these in position at a proper location in a shoe. Hitherto known cushioning pads have had to rely on buckling spring walls or collapsing columns or pins to provide the required cushioning. As a result the prior art cushioning pads have often fallen short of providing the necessary adhesive surface and moreover have lacked such surfaces that have been sufficiently stable. While the partial insole according to the invention can be made from any elastomeric material, including notably polyurethane gel (PU-gel) and thermoplastic elastomer gel (TPE-gel), it is interesting to note that PU-gel has inherent sticky properties that may be advantageously used for adherence to a shoe inner. It is in particular the combination with the groove pattern of the present invention that has made possible the use of this inherent sticky properties of PU-gel. With the smaller surface offered by the prior art patterns of ridges and studs it has often been necessary to resort to high performance adhesive to ensure proper location of the cushioning parts. When removing such prior art pads upon extended periods of use this could often not be attempted without inflicting damage to the shoe inner. The attractiveness of the inherent sticky properties of PU-gel is that it always allows removal and replacement without damage to the shoe. Moreover it also has the required adhesive properties, provided the contact service can meet a minimum value, such as available with the groove pattern proposed by the invention. Polyurethane gels are manufactured by mixing polyols and isocyanate at a specified ratio. Sticky properties are obtained by using excess of polyol. The adhesiveness can be further tuned by altering the ratio between these two components. When the adhesiveness of the gel is low, the gel pad will move around in the shoe during use, whereas when the adhesiveness is too high, the gel pad may damage the shoe inner when it is removed from the shoe. The gel material according to this invention has an adhesive strength between 60 s and 300 s, when measured according to a test method developed to determine the peel resistance of bonded materials. This test measures the time (in seconds) required to pull apart a bonded portion of a sample, having a bonded area of 8.0×3.0 cm and a clamped area of 1.5×3.0 cm, vertically from a metal surface, using a standardized pulling force of 250 g.

Figure 5:
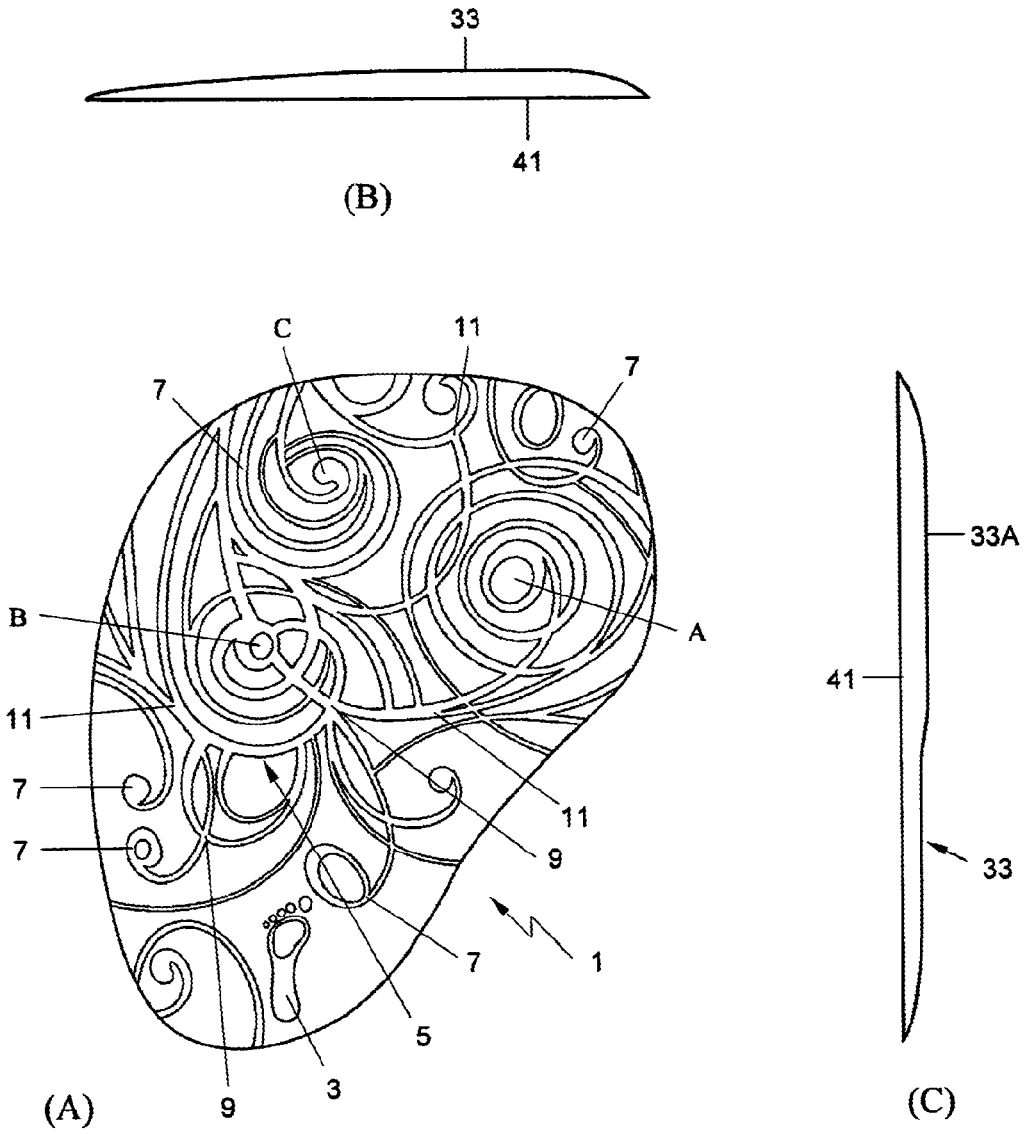
FIG. 5(A) is a plan view of the first embodiment of FIG. 1.
FIG. 5(B) is a front elevation of the partial insole pad of FIG. 5(A)
FIG. 5(C) is a side elevation of the partial insole pad of FIG. 5(A)

Referring now to FIG. 5(A) to (C) the ball of foot insole pad of FIG. 1 is shown in plan view in FIG. 5(A). The front elevation is shown in FIG. 5(B) and the side elevation being shown in FIG. 5(C). The groove pattern is visible through the top surface 33, because the gel material used is transparent. Shown is the recessed groove pattern 5, which is laid out in a combination of partly intersecting 9 and joining 11 swirl formations 7 in grooves that may have a variable width along their length. It is also shown in the longitudinal side elevation of FIG. 5(C) that optionally the thickness of the pad 1 can be increased in the region 33A of the maximum cushioning area A and the medium cushioning area B. An additional cushioning area C may additionally be provided in the region 33A. As stated above the channels may also be formed in a coil-shaped pattern, rather than a swirl pattern.

Figure 6:
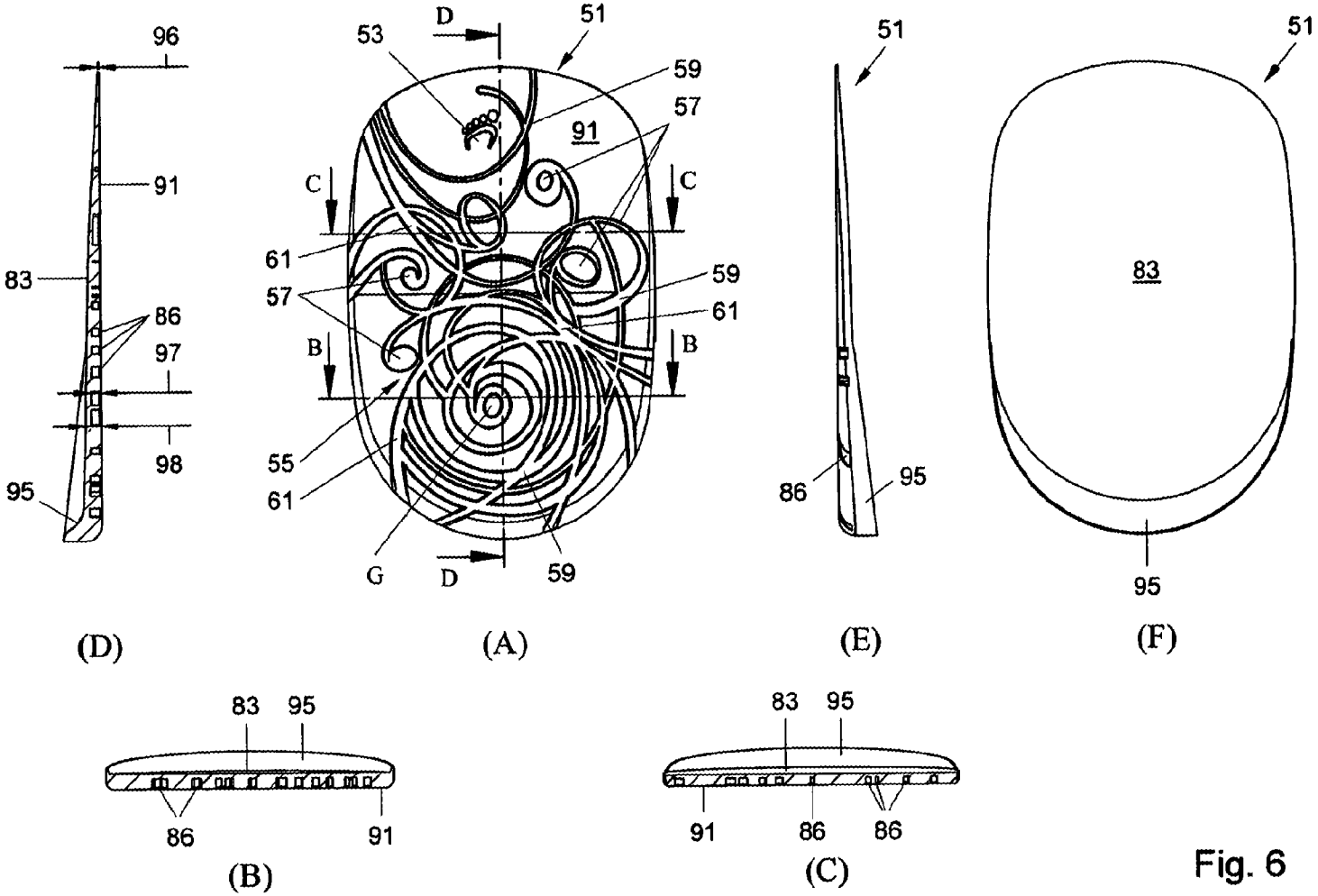
FIG. 6(A) is bottom view of a partial insole pad according to a second embodiment of the invention.
FIG. 6(B) is a transverse cross section of the second embodiment across the line B-B in FIG. 6(A)
FIG. 6(C) is a transverse cross section of the second embodiment across the line C-C in FIG. 6(A)
FIG. 6(D) is a longitudinal cross section of the second embodiment along the line D-D in FIG. 6(A)
FIG. 6(E) is a longitudinal elevation of the partial insole pad according the second embodiment.
FIG. 6(F) is a plan view of the second embodiment.

In FIG. 6 a second embodiment of the partial insole of the invention is represented as a heel pad 51. This heel pad 51 is an opaque variation in which the recessed groove or channel pattern 55 (FIG. 6(A)) cannot be viewed from the top side 83 (FIG. 6(F)). Such an opaque variation, as may be understood by the skilled person, may also result from an opaque film covering the top surface. As will be noted the reference numerals used in the FIGS. 6(A) to 6(F) differ a full "50" from those used in FIGS. 1 to 5 (C), to denote similar features. Again the heel pad 51 is provided with an indicia 53 to indicate the orientation for placement in an item of footwear. The pattern 55 is again composed of recessed channel or groove formations that extend in swirls 57 that intersect at intersections 59 and join one another at junctions 61. Thereby the swirls 57, the intersections 59 and the junctions 61 define differently sized formations with enclosed perimeters between them. These differently sized formations are the contact surface of the bottom surface 91 with the inner sole of an item of footwear. It is easily seen that the surface portion of the bottom surface 91 available for adherence to the footwear exceeds substantially the portion of the surface interrupted by the grooves or channels 86. The channel pattern 55 is also used to vary the density of by the swirls 57, the intersections 59 and the junctions 61 to provide for an area G of maximum cushioning properties. The channels may again be formed in a swirl or coil-shaped pattern, with their centre coinciding in use with a centre of an area of the human foot that is apt to exert a maximum pressure across the foot during walking.

Optionally a rear edge of the heel pad 51 may be provided with an upstanding flange 95, but this is not an essential feature. The thickness of the pad can vary in its longitudinal direction from 0.3 mm at 96, to about 2 mm at 97, and about 3 mm at 98. In the lateral direction the thickness is substantially constant throughout the width as can be noticed from FIGS. 6(B) and 6(C). While the heel pad 51 of FIGS. 6A to F is shown as being opaque it should be clear that it can be made from a transparent PU-gel like the ball of foot pad of the first embodiment. Likewise the ball of foot pad of the first embodiment can be made from an opaque PU-gel material like the heel pad of the second embodiment.

Accordingly a insole pad (1; 51) is described that is suitable for placement on top of an inner sole of footwear and adapted in use to cover only an area of that inner sole, which is substantially smaller than the human footprint. The insole pad (1; 51) includes a relatively thin, sheet-like body that has an upper surface (33) and a lower surface (41) and can define a contoured outer periphery (25). The lower surface (41) has sticky or adhesive properties, and is interrupted by recessed areas arranged in a pattern (5; 55). The pattern (5; 55) is configured to include a plurality of channels combined to be at least intersecting or joining, so as to define a plurality of differently sized non-recessed lower surface areas that preferably have an enclosed perimeter contour. At least a portion of the channels vary in width, while the pattern has a varying density to provide high and low cushioning values in predefined areas A, B, C; G).

It is thus believed that the operation and construction of the present invention will be apparent from the foregoing description. The invention is not limited to any embodiment herein described and, within the purview of the skilled person; modifications are possible which should be considered within the scope of the appended claims. Equally all kinematic inversions are considered inherently disclosed and to be within the scope of the present invention. In the claims, any reference signs shall not be construed as limiting the claim. The term 'comprising' when used in this description or the appended claims should not be construed in an exclusive or exhaustive sense but rather in an inclusive sense. Thus the expression 'comprising' as used herein does not exclude the presence of other elements or steps then those listed in a claim. Furthermore, the words 'a' and 'an' shall not be construed as limited to 'only one', but instead are used to mean 'at least one', and do not exclude a plurality. The mere fact that certain measures are recited in mutually different claims does not indicate that a combination of these measures cannot be used to advantage. Expressions such as: "means for . . . " should be read as: "component configured for . . . " or "member constructed to . . . " and should be construed to include equivalents for the structures disclosed. The use of expressions like: "critical", "preferred", "especially preferred" etc. is not intended to limit the invention. Features which are not specifically or explicitly described or claimed may be additionally included in the structure according to the present invention without deviating from its scope.

The invention claimed is:

1. An insole pad for placement on top of an inner sole of footwear, the insole pad comprising:

a relatively thin, sheet-like body adapted to cover only a portion of the inner sole that is substantially smaller than a total area of the inner sole, the sheet-like body having an upper surface and a lower surface, wherein the lower surface has sticky or adhesive properties; and a plurality of channels recessed into the lower surface, the plurality of channels intersecting and joining with one another at a plurality of junctions to divide the lower surface into a plurality of differently sized non-recessed lower surface areas within a perimeter formed by the plurality of intersecting and joining channels, wherein a combined area of the non-recessed lower surface areas substantially exceeds a combined area of the lower surface occupied by the plurality of channels;

wherein the plurality of channels are varying in width and arranged in a non-uniform pattern to provide high and low cushioning values in predefined areas;

wherein a portion of the sheet-like body between the upper surface and the lower surface elastically deforms into the plurality of intersecting and joining channels when the sheet-like body is placed under load.

2. The insole pad of claim 1, wherein the insole pad is a partial insole adapted for attachment to one of a ball of foot area and a heel area of the footwear.

3. The insole pad of claim 1, wherein a first portion of the lower surface available for adherence to an item of footwear substantially exceeds a second portion of the lower surface occupied by channels of the pattern.

4. The insole pad of claim 1, wherein the insole pad consists substantially of an elastomeric material.

5. The insole pad of claim 4, wherein the elastomeric material is a gelatinous elastomeric material.

6. The insole pad of claim 4, wherein the elastomeric material is a visco-elastic gel.

7. The insole pad of claim 4, wherein the elastomeric material is a polyurethane gel (PU-gel).

8. The insole pad of claim 4, wherein the elastomeric material comprises sticky or adhesive properties that facilitate adhering the insole pad to an item of footwear.

9. The insole pad according to claim 8, wherein the sticky or adhesive properties are tuned by using an excess of polyol and changing a ratio between polyols and isocyanates in a mixture to obtain a PU-gel.

10. The insole pad of claim 4, wherein the elastomeric material is a thermoplastic elastomer gel (TPE-gel).

11. The insole pad of claim 1, wherein the channels are at least partly arranged in an intersecting swirl pattern.

12. The insole pad of claim 1, wherein the relatively thin, sheet-like body has a transverse cross section that tapers outwardly towards an outer periphery of the pad.

13. The insole pad of claim 12, wherein the transverse cross section has a thickness varying between 2.2 and 5.0 mm.

14. The insole pad of claim 1, wherein the channels have a depth of 60% to 75% of the total thickness of the sheet-like body.

15. The insole pad of claim 1, wherein the plurality of recessed channels result in a total weight reduction of 15% to 25% of a weight of the insole pad compared to an insole pad without the plurality of recessed channels.

16. The insole pad of claim 1, wherein the lower surface comprises a border area extending 5 mm inwardly of an outer periphery of the insole pad, wherein the border area is substantially devoid of the plurality of channels.

17. The insole pad of claim 1, wherein the sticky lower surface is covered by a protective layer, adapted to be peeled off prior to placing the insole pad on top of the inner sole of the footwear.

18. The insole pad of claim 1, wherein the upper surface is covered by a non-removable film.

19. The insole pad of claim 1, wherein the plurality of channels are spaced relatively closer to one another to provide the areas of high cushioning values and spaced relatively further from one another to provide the areas of low cushioning values.

20. The insole pad of claim 1, wherein the insole pad is a partial insole configured for use as a ball of foot support pad.

21. The insole pad of claim 1, wherein the insole pad is a partial insole configured for use as a heel area support pad.

22. The insole pad of claim 1, wherein a material of the insole pad has a uniform hardness throughout.

23. The insole pad of claim 22, wherein the hardness is between 55 and 70 Shore OO.

24. The insole pad of claim 6, wherein the insole pad is made of a material comprising a void/gel ratio that is subdivided to include:

30 to 45% at a first area that requires high cushioning properties;

15 to 30% at a second area that requires medium cushioning properties; and 0 to 15% at a third area that requires low cushioning properties.

25. The insole pad of claim 1, wherein the insole pad is configured to support a human foot that exerts different pressures upon different areas of the insole pad during walking, the foot exerting a highest pressure at a predefined area of the insole pad;

wherein the channels are formed in a coil-shaped pattern, with a centre of the coil-shaped pattern coinciding with a centre of the predefined area of the insole pad upon which the human foot exerts the highest pressure across the foot during walking.

26. The insole pad of claim 1, wherein a thickness between the upper and lower surfaces is reduced substantially by one third at an applied pressure typical for a walking load.

27. The insole pad of claim 14, wherein the channels have a depth of approximately 67% of the total thickness of the sheet-like body.

28. The insole pad of claim 23, wherein the hardness is approximately 60 Shore OO.

29. The insole pad of claim 24, wherein the void/gel ratio is approximately 35% at the first area that requires high cushioning properties.

30. The insole pad of claim 24, wherein the void/gel ratio is approximately 25% at the second area that requires medium cushioning properties.

31. The insole pad of claim 24, wherein the void/gel ratio is approximately 10% at the third area that requires low cushioning properties.

* * * * *